United States Patent [19]

Calabrese

[11] Patent Number: 4,987,936

[45] Date of Patent: Jan. 29, 1991

[54] CUE TIPPERS

[76] Inventor: Peter A. Calabrese, 18 Gallow's Row, Minersville, Pa. 17954

[21] Appl. No.: 487,909

[22] Filed: Mar. 5, 1990

[51] Int. Cl.[5] ..... B27G 1/00

[52] U.S. Cl. ..... 144/346; 51/181 R; 30/494; 144/3 R; 144/134 R; 144/2 R; 144/344; 144/352; 156/539; 269/43; 269/287

[58] Field of Search ..... 156/539, 556; 269/43, 269/287; 51/181; 30/494; 144/3 R, 1 R, 134 R, 346, 352, 2 R

[56] References Cited

U.S. PATENT DOCUMENTS

| | | | |
|---|---|---|---|
| 4,471,824 | 9/1984 | Zownir | 144/134 R |
| 4,594,782 | 6/1986 | Willard | 30/494 |
| 4,620,370 | 11/1986 | Zowner et al. | 30/494 |
| 4,785,586 | 11/1988 | Kratfel | 51/181 |

OTHER PUBLICATIONS

Willrds's, Classic Tipper-Trommer Brochure.
Willard's, Cue Tip-Shipper Brochure.

*Primary Examiner*—W. Donald Bray

*Attorney, Agent, or Firm*—Donald C. Watson

[57] ABSTRACT

A cue tipper 42 for a stick 33 includes a positioner 44 having in a side 47, a cavity 48 centered around a preferred assembly axis V—V and facing toward a stick holder 54. Holder 54 has a device 56 to clamp a cue stick so a planar free end 35 faces cavity 48 and its centerline C-S coincides with the assembly axis V—V. A mover system 60 has a guide pin 62 affixed to holder 54 and extended slidably through positioner 44. A mover pin 64 is connected to positioner 42 and is threadably engaged to holder 54. In operation, a tip 20 has a planar end 26 contacted to the free end 35 of stick 33 and the positioner 44 and holder 54 are moved together by system 60. Cavity 48 engages primarily a desired dome 30 of a cap 22 on the tip 20and tip 20 is moved laterally and rotatively as required normal to assembly axis V—V until base plane 29 of dome 30 is made normal to axis V—V and dome centerline C-D coincides with axis V—V in a disposition preferred by pool players. A tip 20 is so assembled to a cue stick 33 even through the tip 20 is initially provided with a cap 22 which is tilted with respect to its planar end 26.

14 Claims, 5 Drawing Sheets

PRIOR
ART
34
H-H
C-S
36
41
220
37
200
39
300
40
32
38
280
35
240
260
33

PRIOR
ART
36
34
41
37
39
220
300
40
280
200
240
260
32
38
35
33

PRIOR
ART
33
200
230

PRIOR
ART
400
S
C-S
220
S
200
290
280
230
EW7
EW8
35
240
33
V-V
C-S
C-D
44
CD
TD
OD
45 46

CUE TIPPERS

TECHNICAL FIELD

This invention relates to apparatus for assembling to a cue stick, a tip designed to strike and propel a ball over a flat surface. !!ore particularly, games such as pool and billards require that balls be driven along a precise path over a covered flat surface. To facilitate playing such games cue sticks are provided and tapered to a free end to which there is assembled an impressionable member, called a "tip". This invention relates to apparatus for assembling with precision such tips to cue sticks.

BACKGROUND OF THE INVENTION

A cue stick is typically made about five feet long and of wood such as ash or maple, and tapers to from about 11 m.m. to about 14 m.m. diameter at a free end. To such free end there is assembled, typically by a form of adhesive, a short, often rounded tip typically made of an impressionable material such as leather. The purpose of the tip is to facilitate striking a cue ball with a cue stick. The tip permits the cue ball to be pressed into the leather to better engage the free end of the cue stick to the cue ball. Another purpose for the tip is to protect the cue ball from nicks and scratches. A further purpose for the tip is to impart a given "spin" to a cue ball, sometimes called giving "english" to the ball. Still another purpose for the tip is to enhance the velocity with which a cue ball may be driven. The tip also protects the end of a cue stick from splitting and splintering upon impact with a cue ball. For these and other reasons, cue tips are of much concern to pool and billiard players.

Most tips are purchased in a substantially preformed condition. Heretofore, tips were often merely cylindrical in form, having planar faces on each of two ends and being wider than the expected width of a cue stick. The forming of such a tip after it is glued to a cue stick is explained at some length in U.S. Pat. No. 4,471,824 to M. Zownir. Another reference disclosing means for forming such a tip after it is glued to a cue stick is U.S. Pat. No. 4,594,782 to J. Willard, showing at FIG. 6, a condition before forming and at FIG. 5, a condition after forming such a cue tip.

Another preformed tip has a convex cap portion for striking a ball and a generally cylindrical portion with a planar end for connection to the free end of a cue stick. The cap and connecting portions are typically wider than the expected width of a cue stick. Heretofore, it is believed that most such tips were manually adhered to the free end of a cue stick without special alignment tools. Then the excess width was trimmed utilizing a trimmer such as that disclosed in U.S. Pat. No. 4,620,370 to M. Zownir.

A problem with manually aligning cue tips having convex striking portions is that one must estimate by sight, the location of the centerline of the striking portion of the cap and the centerline of the cue stick. Then the tip must be adhered to the free end of the cue stick by aligning the two centerlines, a very tedious procedure. A further complication is that one must be sure that the tip does not move laterally by gravity or by bumping while the adhesive is setting up. A further problem is that a convex cap is sometimes tilted with respect to the connecting portion of a tip during preforming and it is then difficult to observe a desired dome portion of a cap and to offset the tip on a stick to utilize the centerline of such dome portion for alignment.

A prior art device is provided for mechanically aligning to cue sticks, tips having convex caps and connecting portions. Such a device is sold as "Willard's Classic Tipper-Trimmer" by Willard's, P.0. Box 156, Aurora, Ill. 60507 and it is believed that application for patent has been made on such device. A problem with the Willard device is that it primarily engages only the cylindrical connecting portion of a tip and aligns the same to the centerline of a cue stick. Consequently, the Willard device does not align to the cap and is not seen to correct for a tip having its cap tilted with respect to its connecting portion. Another problem with the Willard device is that separate collets and tip holders must be purchased and respectively installed in the device for different sizes of cue sticks and tips. A further problem is that the Willard device does not adjustably, mechanically press a tip to a cue stick. Another problem is that the Willard device weighs so much and is so large that it cannot readily be carried in a standard cue stick pouch or in one's pocket.

Accordingly, it is desirable to provide new and improved apparatus for assembling to a cue stick, a tip having a convex cap portion for striking a ball. It is desirable to mechanically align such a tip to a cue stick for trimming to a symmetrical tip even though the cap may be tilted with respect to the connecting portion. It is further desirable that such apparatus include means for assembling to a cue stick, tips of more than one size. Such apparatus should adjustably press a tip to a stick. And such apparatus should be sufficiently light in weight and small in size to be carried in a standard cue pouch or in an adult player's pocket.

SUMMARY OF THE INVENTION

Expedients are provided for assembling to a cue stick, a tip having a convex cap portion for striking a ball and a portion with a planar end for connecting the tip to such cue stick. There is provided a stick holder having first and second opposing sides and containing a clamping device for fixedly holding the cue stick. An internal centerline of such stick coincides with a given assembly axis and a free, tip end of such cue stick protrudes from the first side of the holder. There is disposed opposite the first side of the tip holder, a tip positioner having a second side and a first, opposing side facing toward the first side of the stick holder. An advantageous cavity in the first side of the tip positioner is adapted to engage primarily the cap of a tip so a desired dome portion of such cap has a desired centerline coinciding with the assembly axis. The connecting portion of the tip has its planar end facing toward and parallel with the free, tip end of the cue stick. Members such as pins are utilized to connect the tip positioner to the stick holder for adjustably, guidably, moving together, the positioner, the cue tip and free end of the cue stick into clamping contact. The centerlines of the desired dome of the cue tip and stick are held therealong in coincidence with the assembly axis for assembling the tip to the stick.

In another embodiment, reference is made to a theoretical plane at a base of the cap portion of the tip. The cavity in the positioner has surfaces curved to accept the curvature of the convex cap. A dome portion of the cavity has a theoretical base plane and normal thereto, a centerline coinciding with the assembly axis. To accommodate a tip having a cap with a randomly disposed base plane which may be tilted, the cavity is made sufficiently wide so the tip may be moved normally, laterally and rotatively to the assembly axis as required until the desired dome portion of the cap fits into the desired domed portion of the cavity. The pins may be adjusted to move the positioner, cue tip and free end of the cue stick together without tilting the end of the tip on the end of the stick even though the cap portion is tilted on the cue tip.

In another embodiment, the positioner contains a plurality of cavities which may be of varied sizes and shapes. The pins for moving may be adjusted to align a cavity of a selected size and shape to the free end of the cue stick for assembling a cue tip of such size and shape to a cue stick.

BRIEF DESCRIPTION OF THE DRAWING

The invention will be more readily understood from the following detailed description when read in conjunction with the accompanying drawing wherein.

Figure 1:
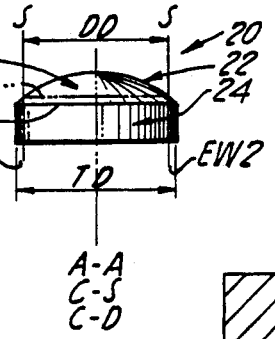
FIG. 1 is a side view of an unassembled cue tip having a convex cap portion and a connection portion.

It can be seen that some features in the figures are abbreviated or simplified to highlight certain aspects of the invention. Also, where appropriate, reference numerals have been repeated in the figures to designate the same or corresponding features.

DETAILED DESCRIPTION

Normal Tips

It is well known among pool and billiard players, that a slight error in striking a ball can make a serious difference in the path and spin of the ball and results of the play. Consequently, cue sticks are made with precision and checked for good condition before playing.

It is further believed that a player aims each shot according to the internal centerline of a cue stick. The player expects to hit a cue ball primarily where such centerline theoretically exits from a tapered down, free end of such cue stick. Accordingly, tips are assembled to cue sticks with care and such tips are shaped in a convex manner so a dome portion strikes a ball primarily at the centerline of such stick. FIG. 1 illustrates a typical tip 20, having a convex cap portion 22 and a generally cylindrical portion 24, for connecting the tip 20 to a cue stick (not shown). An end portion 26 is typically formed in a planar manner to contact and be adhered to a planar end of a cue stick.

The cap 22 is generally spherical in shape having a radius to suit the desire of a player. For example, many players prefer a cap 22 having a nickel (0.415 inch) or a dime (0.358 inch) radius. A cap 22 may have these or any reasonable radius and be assembled in the practice of this invention.

The connecting portion 24 is generally cylindrical in shape and has a diameter to suit a cue stick preferred by a player. Most players prefer cue sticks with free ends having diameters ranging from about 11.0 m.m. to about 14.0 m.m. A connecting portion 24 of tip 20 is typically provided about 0.5 m.m. wider than a cue stick to permit trimming a tip to a preferred stick. The overall diameter TD of an unassembled tip 20 may be from about 11.5 m.m. to about 15.5 m.m. although such dimension is not critical to the practice of the invention.

It is useful in explaining assembling of tips to cue sticks, to define an assembly axis A—A as shown in FIG. 1. It is desirable that a centerline CS of a cue stick (not shown) coincide with the assembly axis A—A and that the portion of tip 20 which strikes a ball also has a centerline coincident with axis A—A. Theoretical lines S—S are drawn in FIG. 1 to straddle axis A—A and centerline CS and to simulate sides of a cue stick to which an assembled tip 20 is often trimmed. Lines S—S indicate that tip 20 has an annular extra width portion which protrudes a distance EW1 on a left side and EW2 on a right side and such may be equal when tip 20 is assembled to and trimmed about a cue stick.

It will be noted that lines S—S intersect the convex outline of cap 22 in the side view in FIG. 1. If lines S—S are rotated about axis A—A, there is defined a dome portion 30 having a centerline C-D and a diameter D—D. Dome 30 is desired for location about the internal centerline C-S of a cue stick for properly striking a cue ball. All features of dome 30 are symmetrical with respect to centerline C-S and it will be seen that such symmetry is not always present with respect to a cap portion 22.

Note in FIG. 1, that cap 22 has a theoretical base plane 28 along a line joining the cap 22 and the connecting portion 24. Such plane 28 is often, although not always, substantially parallel with respect to planar end 26. Note also that the desired dome 30 has a theoretical base plane 29 along a line joining the dome 30 to a cylindrical portion left after trimming an assembled tip 20. Dome base plane 29 is normal to centerlines C-S and C-D and assembly axis A—A.

FIGS. 2A-2D show prior art expedients for assembling to a cue stick 33, a tip 20 having a convex cap portion 22 and a connecting portion 24. FIGS. 3A-3D show expedients of the present invention for assembling to a similar cue stick 33, a similar tip 20 having similar features. It will be seen that the expedients of the prior art and the instant invention are substantially different but produce similar assemblies when tips 20 have reasonably symmetrical features when located about an axis A—A. Advantages are different and will be explained.

Figure 2A:
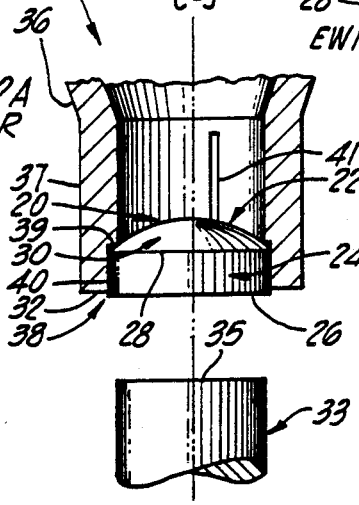
FIG. 2A PRIOR ART
FIG. 2A is a sectional view of a prior art tip positioner containing a cue tip having a convex cap. A portion of a cue stick having a planar, free end is shown ready for assembly to the cue tip.

FIG. 2A shows a prior art tip positioner 34 including a round holder sleeve 36 tapering to a barrel portion 37 having a recessed cavity 38 with an internal, annular shoulder 39 and walls 40. Slots 41 are provided in barrel 37 so when a tip 20 is forcibly inserted into the cavity 38, the walls 40 are biased inwardly and grip the connecting portion 24 of such tip 20. Note in this step that the cue stick 33 is fixedly held symmetrically about its centerline C-S and assembly axis H—H and it has a free planar end 35 separated from planar end 26 of tip 20.

Figure 3A:
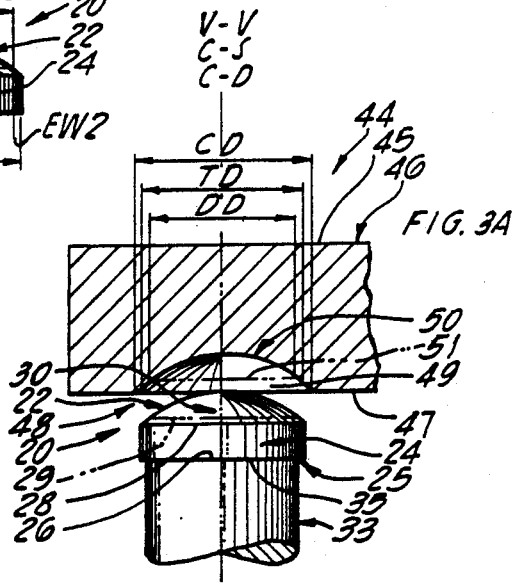
FIG. 3A is a sectional view of a tip positioner, according to the instant invention. A tip having a convex cap and a connecting portion is shown in contact with a planar, free end of a cue stick portion.

FIG. 3A shows a tip positioner 44, and a tip 20 supported on a cue stick 33 according to a step for positioning such tip in the practice of the invention. Cue stick 33 is fixedly held by apparatus (not shown—to be described later) with an internal centerline C-S of stick 33 coinciding with a preferred assembly axis V—V.

Positioner 44 includes a plate 46 having a second side 45 and a first opposing side 47 facing toward the stick 33. In side 47, there is provided a recessed cavity 48 for positioning at least one cue tip 20 on the free end 35 of the cue stick 33.

Note that cavity 48 has internal surfaces 49 curved to substantially complement and accept the external surfaces of the convex cap 22 of a tip 20. A dome portion 50 of the cavity 48 has a theoretical base plane 51, and normal thereto, a centerline C-D which advantageously coincides with the assembly axis V—V.

Note that the dome 50 in cavity 48 has a diameter D—D to complement the diameter D—D of dome 30 of a cap 24 of a tip 20. Note also that the diameter D—D is smaller than the diameter TD of a tip 20. The cavity 48 could have a diameter TD to complement the normal diameter of a tip 20 and still be utilized in positioning such tip in the practice of the invention. It is desirable however, for cavity 48 to have a diameter CD which is larger than diameter TD of tip 20 for reasons that will be explained in operation of the invention and particularly when positioning an abnormal tip which will also be explained.

In operation of the prior art apparatus for the positioning step as shown in FIG. 2A, one inserts a tip 20 in the cavity 38 as shown in FIG. 2A. The sleeve 36 and the cue stick 33 are held by fixtures (not shown) in alignment along assembly axis H—H. Adhesive is applied to the end 26 of tip 20, care being taken to avoid getting such adhesive on features of sleeve 36, such as on ends 32, the walls 40 and the shoulder 39 of cavity 38. The proliferation of adhesive on such features is such a consideration that the prior art sleeve 36 is often made of an expensive, slick plastic to shed errant adhesive.

The unseen fixtures of the prior art hold sleeve 36 and cue stick 33 in horizontal disposition, i.e., the sleeve holds tip 20 so its planar end 26 extends vertically and readily sheds adhesive after it is applied to the tip 20. The apparatus of the present invention which holds tips and sticks will be explained later and will be seen to hold tips and sticks in any disposition desired. It is found desirable to hold sticks vertically and tips with end planes extending horizontally, to control flow of adhesive and to better control positioning of tips. FIGS. 2A-B and FIGS. 3A-B are shown respectively, opposite one another for comparison, but it is to be remembered that the prior art fixtures are designed for bench work along a horizontal assembly axis H—H. The apparatus of the instant invention is designed for mobility and portability. The apparatus of the invention may be utilized in any desired disposition although assembly along a vertical axis V-V is preferred.

Figure 2B:
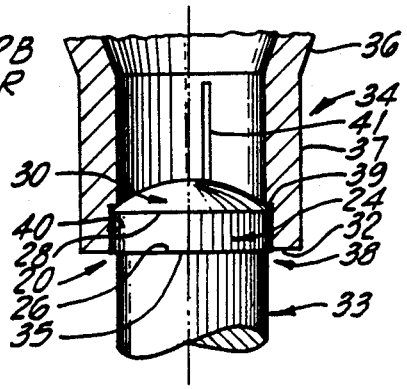
FIG. 2B PRIOR ART
FIG. 2B is similar to FIG. 2A, wherein movement of the positioner is shown to cause the tip to contact and be assembled to the free end of the cue stick.

After application of adhesive to end 26 of the tip 20 in FIG. 2A, the sleeve 36 is manually moved, horizontally toward fixed cue stick 33, until ends 26 and 35 are contacted as shown in FIG. 2B. Then sleeve 36 is held by a thumb set screw (not shown). It can be seen in FIG. 2B, that control of the lateral positioning of tip 20 is fully dependent upon contact of walls 40 of cavity 38 to connecting portion 24 of tip 20 and alignment of sleeve 36 to cue tip 33. There is no effort seen to engage primarily cap 22 or to engage cap 22 at all. It is believed that the position of cap 22 with respect to the internal centerline of cue stick 33 is dependent upon how tip 20 is originally fabricated and not upon how a tip 20 is assembled to a cue stick.

In operation of the apparatus of the invention for the positioning step as shown in FIG. 3A, one applies adhesive to the end 26 of a tip 20 which is then applied to the cue stick 33 as shown. Plate 46 is then lowered to a position close enough so cavity 48 may be utilized to gauge the position of tip 20. The tip 20 is then moved normally to axis V—V in a lateral direction and such tip may be rotated as required until the desired dome 30 of the cap 22 fits into the desired dome portion 50 of the cavity 48.

Figure 3B:
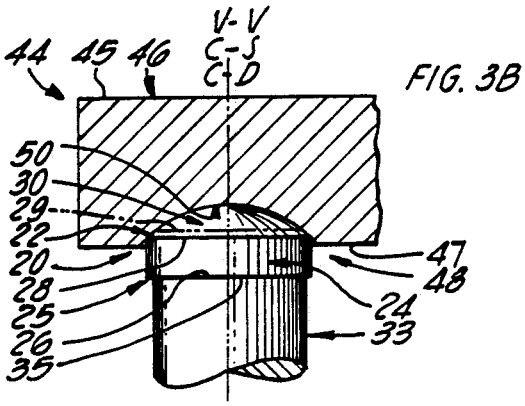
FIG. 3B is a view similar to FIG. 3A, wherein movement between the positioner and the stick is seen to cause precise positioning of the tip and clamping contact to the stick according to the instant invention.

Normally, merely bringing cavity 48 down over a cap 22 of a tip 20 will adjust the position of the tip on the stick 33 as shown in FIG. 3B. The precise position of the tip 20 on a stick 33 may be further checked when plate 46 is fully lowered and cavity 48 is pressed down upon cap 22. When the tip 20 is properly positioned, the positioner 44 may press tip 20 to the free end 35 of the cue stick 33 without tilting the connecting portion 24 and its end 26 with respect to the free end 35 of the cue stick 33. Advantageously such pressing of cavity 48 into cap 22 is found to further movably, adjust and properly position tip 20 as shown in FIG. 3B.

It can be seen in FIG. 3B, that control of the lateral positioning of a tip 20 is primarily dependent upon contact of surfaces 49 of cavity 48 to cap 22 and alignment of dome 50 to cue stick 33. Tip 20 is free to be pushed about by such surfaces 49, there being sliding movement between end 26 of the tip 20 and end 35 of the cue stick 33, often advantageously assisted by inherent lubrication of tip adhesives. Tip 20 is engaged primarily by its cap 22 and the position of tip 20 is dependent upon the position of cap 22 in the assembly to stick 33 and not upon how a tip 20 is originally fabricated.

Figure 2C:
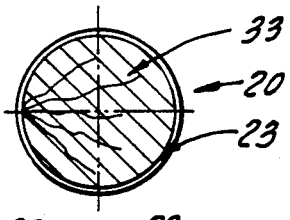
FIG. 2C PRIOR ART
FIG. 2C is an end view of the cue tip and stick portion shown in FIG. 2B, wherein excess annular portions of the assembled cue tip are seen to extend beyond the sides of the cue stick.
Figure 3C:
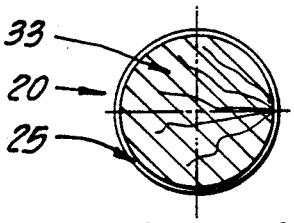
FIG. 3C is an end view of the cue tip and stick portion shown in FIG. 3B, wherein excess annular portions of the assembled cue tip are seen to extend beyond the sides of the cue stick.

FIG. 2C-D and FIGS. 3C-D are provided to show that, when all goes well, the apparatus of the prior art and that of the instant invention produce similar, although not precisely, the same results. FIG. 2C and FIG. 3C show end views of a tip 20 mounted to a cue stick 33 after adhesive has set and before a trimming step. In each case annular portions 23 (FIG. 2C) and 25 (FIG. 3C) of the assembled cue tip 20 are seen to be excess to what is needed and such portions are seen to extend beyond the sides of cue stick 33.

Figure 2D:
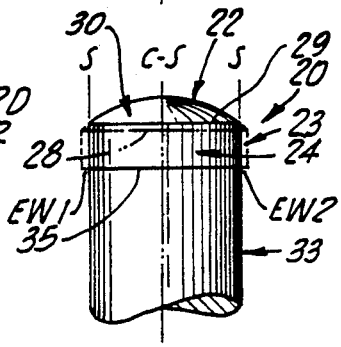
FIG. 2D PRIOR ART
FIG. 2D is a side view of the assembled cue tip and stick shown in FIG. 2B, wherein the excess tip portions are trimmed from the convex cap and the connecting portion of the tip and are made even with the sides of the cue stick.
Figure 3D:
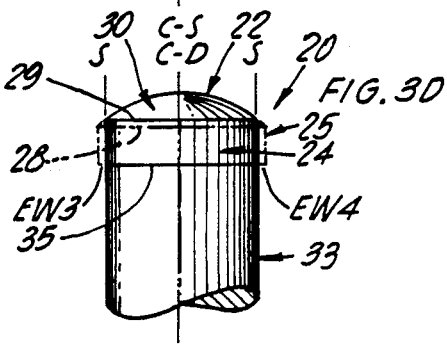
FIG. 3D is a side view of the assembled cue tip and stick shown in FIG. 3B, wherein the excess annular tip portions are trimmed from the convex cap and the connecting portions of the tip and are made even with the sides of the cue stick.

FIG. 2D and FIG. 3D are side views similar to FIG. 1, but each showing an assembled cue tip 20 to a cue stick 33, after a trimming step wherein the trimmed portions are shown in phantom lines. Note that when a tip 20 is preformed in a symmetrical manner that extra width dimensions EW1 and EW2 (along lines S—S representing the sides of stick 33) are substantially equal. In the prior art, such dimensions were normally always equal because the walls 40 of cavity 38 were made to exactly straddle the sides of a cue stick 33. In FIG. 3D, the trimmed portions are shown to extend beyond side lines S—S, by different extra width dimensions EW3 and EW4 because it is not expected that such dimensions will be exactly equal. The cavity 48 controls the position of a tip 20 in the practice of the invention and causes domes 50 and 30 to straddle the centerline C-S which is believed to be most desired by players in aiming a cue stick 33. Consequently, the extra width distances may be closely equal for a reasonably symmetrically formed cue tip 20, but EW3 and EW4 are rarely expected to be precisely equal in FIG. 3D.

FIG. 2D and FIG. 3D also show that the trimmed portions come off both connecting portion 24 and the cap 22. Such differing amounts are readily seen by reference to base lines 28 and 29 of a tip 20.

Abnormal Tips

Figures 4, 5A, 5B, 5C, 5D, 6A, 6B, 6C, 6D:
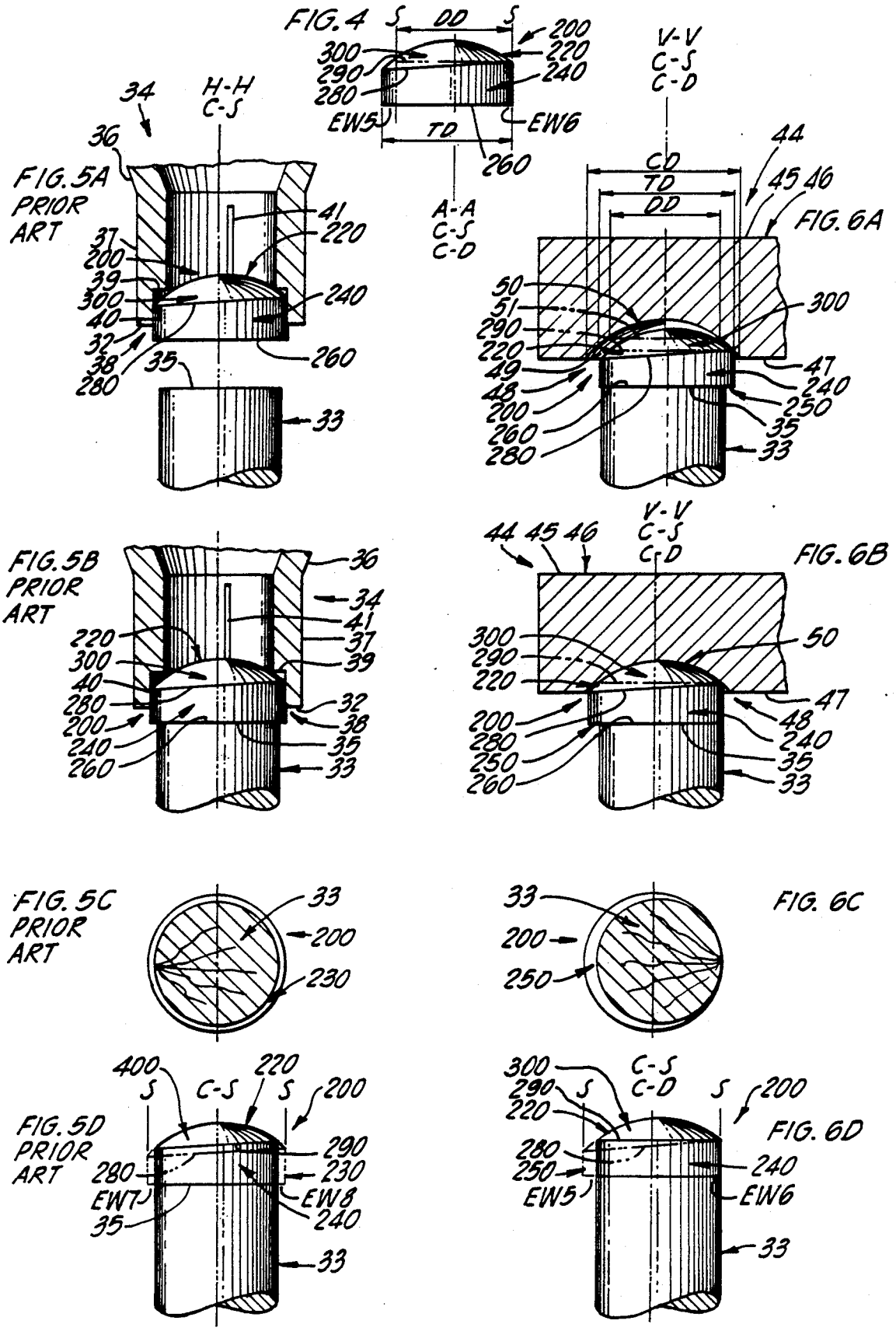
FIG. 4 is a side view of an unassembled cue tip having a convex portion, which is tilted with respect to its connecting portion.
FIG. 5A is a sectional view of a prior art tip positioner and cue stick portion similar to that shown in FIG. 2A. However, the tip positioner contains a cue tip having a tilted convex cap.
FIG. 5B is similar to FIG. 5A, wherein movement of the positioner is seen to cause the tip to contact and be assembled to the free end of the cue stick.
FIG. 5C is an end view of the cue tip and stick portion shown in FIG. 5B, wherein annular portions of the assembled cue tip are seen to extend beyond the sides of the cue stick.
FIG. 5D is a side view of the assembled cue tip and stick shown in FIG. 5B, wherein the annular tip portions are trimmed from the tip which is made even with the sides of the cue stick.
FIG. 6A is a sectional view of a tip positioner and cue stick portion according to the instant invention and similar to that shown in FIG. 3A. However, the cue stick supports a partially assembled cue tip having a tilted convex cap.
FIG. 6B is a view similar to FIG. 6A, wherein the tip has been positioned to fit a desired dome portion to a desired dome portion of a cavity on the positioner. Movement between the positioner and the stick causes precise positioning and clamping contact to the stick, all according to the instant invention.
FIG. 6C is an end view of the cue tip and stick portion shown in FIG. 6B, wherein excess non-annular portions of the assembled cue tip are seen to extend beyond the sides of the cue stick according to the instant invention.
FIG. 6D is a side view of the assembled cue tip and stick portion shown in FIG. 6B, wherein the excess, nonannular tip portions are trimmed from the convex cap and connecting portions of the tip and are made even with the sides of the stick according to the instant invention.

FIG. 4 illustrates a tip 200 having a convex cap portion 220 and a generally cylindrical portion 240 for connecting tip 200 to a cue stick (not shown). An end 260 is typically formed in a planar manner to contact and be adhered to a planar end of a cue stick.

A problem with tip 200 is that its cap 220 is tilted with respect to its end 260. Other features of a tip 200 are generally the same as normal cue tips 20. For example, the radius of a cap 220 may be substantially the same as a nickel or a dime radius. Also, the diameter of the connecting portion 240 may be from about 11.5 m.m. to about 15.5 m.m. and the material may be of an impressionable material such as leather.

FIG. 4 also shows a desired assembly axis A—A, a desired internal stick centerline C-S and theoretical lines S—S to straddle line C-S to simulate the sides of a cue stick 33 to which an assembled tip 200 is to be trimmed. Lines S—S indicate that tip 200 has an annular extra width portion which protrudes a distance EW5 on a left side and EW6 on a right side. Such distances are different according to the practice of the invention although not so different as shown in FIG. 4 where the cap 220 is tilted an unusual amount to highlight such abnormality and contrast its treatment in the prior art compared to that of the invention.

It will be noted in FIG. 4, that lines S-S intersect the convex outline of cap 220 in the side view of FIG. 4. If lines S—S are rotated about axis A—A, there is defined a dome portion 300 having a centerline C-D and a diameter DD which is desired for location about the centerline C-S of a cue stick for properly striking a cue ball. All features of dome 300 are symmetrical with respect to centerline C-S although such symmetry is not true of the remainder of cap 220.

Note in FIG. 4, that cap 220 has a theoretical base plane 280 along a line joining the cap 220 to the connecting portion 240. Such plane 280 is shown substantially non-parallel with respect to planar end 260 in FIG. 4 because cap 220 is tilted on the tip 200 with respect to end 260. Even a small amount of such tilting is considered unsatisfactory by many of the best players and may explain unexpected performance of some pool shots during tournament play. Note also, that the desired dome 300 has a theoretical base plane 290 along a line joining the dome 300 to a cylindrical portion left after trimming an assembled tip 200. Dome base plane 290 is normal to centerlines C-D and assembly axis A—A.

FIGS. 5A-5D show prior art expedients for assembling to a cue stick 33, a tip 200 having a convex cap portion 220 and a connecting portion 240 and wherein cap 220 is tilted with respect to planar end 260. FIGS. 6A-6D show expedients of the present invention for assembling to a similar cue stick 33, a similar tip 200 having similar features. It will be seen that the expedients of the prior art and the instant invention are substantially different and produce substantially different assemblies when tips 200 have even slightly unsymmetrical features when located about an axis A—A. These and other advantages of the instant invention will be noted from this description.

FIG. 5A shows the prior art tip positioner 34 having the same features as were explained for FIG. 2A. FIG. 6A shows the tip positioner 44 of the instant invention having the same features as were explained for FIG. 3A. In both figures, a portion is shown of a cue stick 33 which is fixedly held by apparatus (not shown) with an internal centerline C-S of stick 33 coinciding with a preferred assembly axis. In the prior art, the preferred assembly axis was seen to be a horizontal axis H-H as shown in FIG. 5A. According to the practice of the invention the assembly axis may be randomly disposed but it is preferred to have a vertical axis V—V as shown in FIG. 6A.

In operation of the prior art apparatus for the positioning step as shown in FIG. 5A, one forcibly inserts a tip 200 in the cavity 38. Adhesive is applied to the end 260 of tip 200 and the sleeve 36 and the cue stick 33 are aligned in fixtures (not shown) along assembly axis H-H. Sleeve 36 holds tip 200 so its planar end 260 extends vertically and tends to shed adhesive.

After application of adhesive and alignment, the sleeve 36 is manually moved horizontally toward fixed cue stick 33, until ends 260 and 35 are contacted as shown in FIG. 5B. Then sleeve 36 is held in place by a thumb screw (not shown). Note especially in FIG. 5B, that control of lateral (or axial) positioning of tip 200 is dependent upon contact of walls 40 of cavity 38 to connecting portion 240 of tip 200 and to alignment of sleeve 36 to cue stick 33. Consequently, there is no provision seen for correcting for abnormal of even slight error in fabrication of a tip 200 with regard to a tilted cap 220.

In operation of the apparatus of the invention for the positioning step as shown in FIG. 6A, one applies adhesive to the end 260 of a tip 200 which is then applied to the cue stick 33. Stick 33 is held vertically along axis V—V so the adhesive-wetted ends 260 and 35 are supported horizontally and the adhesive tends to retain on such ends without shedding. Such adhesive is preserved and unwanted shedding on fixtures is minimized, if not avoided.

Plate 46 of the positioner 44 shown in FIG. 6A is then lowered to a position close enough so cavity 48 may be utilized to gauge the position of the tip 200. The tip 200 is then moved normally to axis V—V in a lateral direction and such tip may be rotated as required until the desired dome 300 of cap 220 fits into the desired dome portion 50 of the cavity 48.

FIG. 6A illustrates that the surfaces 49 of cavity 48 engage a high portion of a tilted cap 220 and tend to move tip 200 laterally (or rotatively) as plate 46 is lowered upon a tip 200.

The precise position of the tip 200 may be further checked when plate 46 is fully lowered and cavity 48 is pressed upon cap 220 as shown in FIG. 6B. Such checking is further facilitated by the relationship of dome 50 to dome 300 and the parallel relationship of dome base plane 290 to planar end 260. When properly positioning of tip 200 is obtained, the positioner 44 may press tip 200 to the free end 35 of the cue stick 33 without tilting the end 260 with respect to free end 35 of cue stick 33.

FIGS. 5C-D and FIGS. 6C-D are provided to show the vast differences between results obtained by apparatus of the prior art and that of the instant invention in the assembly of a tip 200 to a cue stick 33. FIG. 5C and FIG. 6C show respective end views of a cue stick 32 and a tip 200 mounted thereon after adhesive has set and before a trimming step. In each view annular portions 230 (FIG. 5C) and 250 (FIG. 6C) of the assembled cue tip 220 are seen to be excess to what is needed or desired and such portions extend beyond the sides of cue stick 33.

FIG. 5D and FIG. 6D are side views similar to FIG. 4, but each show an assembled cue tip 200 to a cue stick 33, after a trimming step wherein the trimmed portions 230 and 250 are shown in phantom lines. Note in FIG. 5D, that the extra width dimensions EW7 and EW8 along lines S—S representing the sides of stick 33 are substantially equal. Note that a dome 400 remains on tip 200 for contact when striking a cue ball and further that the dome 400 is tilted unsymmetrically with respect to the internal centerline C-S of the stick 33.

No such tilting and concomitant asymmetry remains in FIG. 6D. The tip 200 has been trimmed by reference to lines S—S representing extension of the sides of cue stick 33. The side view FIG. 6D shows that portion 250 has extra width dimensions EW5 and EW6 which are not equal. The annular trimming has permitted removal of asymmetrical portions having a maximum width EW5 and a minimum width EW6 which is shown as almost zero. More importantly, a dome 300 is delineated which is symmetrically disposed about the internal centerline C-S of the cue stick 33.

FURTHER APPARATUS OF THE INVENTION

Figure 7:
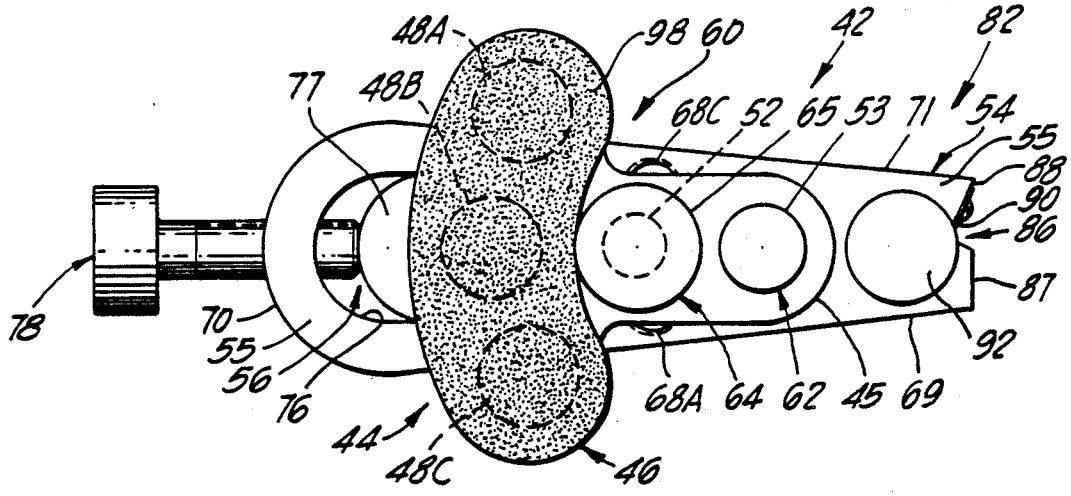
FIG. 7 is a plan view of apparatus for assembling to a cue stick, a tip having a convex cap and connecting portion according to the instant invention.
Figure 8:
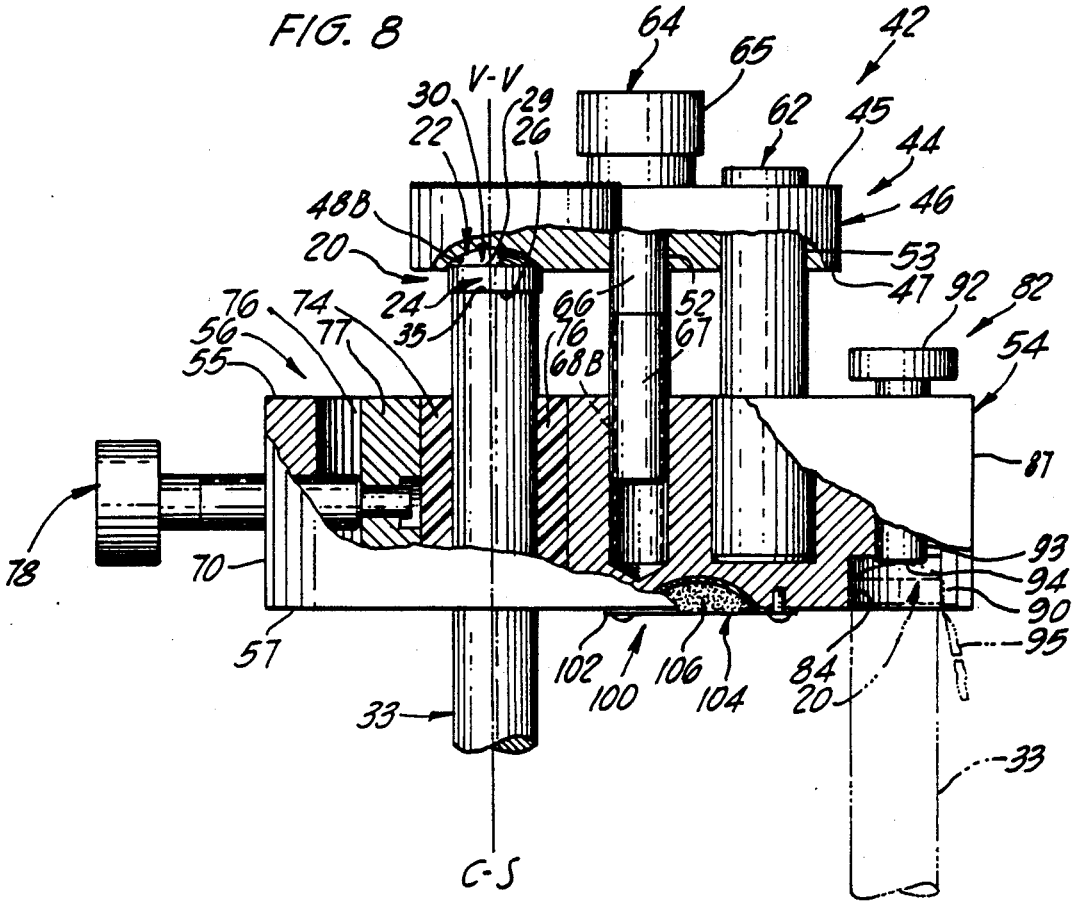
FIG. 8 is a partially sectioned, side view of the apparatus shown in FIG. 7.

FIG. 7 is a plan view which illustrates a preferred orientation of apparatus of the instant invention designated generally by the numeral 42. FIG. 8 is a partially cutaway, side view of apparatus 42 shown in FIG. 7.

The apparatus 42 includes a stick holder 54 having a first side 55, a second side 57 and a clamping device 56 for fixedly holding a cue stick such as the stick 33. Cue stick 33 is held so an internal centerline C-S coincides with a given assembly axis V—V. In FIGS. 7-11 and 13, cue stick 33 is held so its centerline C-S coincides with a preferred vertical assembly axis V—V. Note that a free, tip end 35 of such cue stick 33 protrudes from the first side 55 of the holder 54. The free end 35 of stick 33 in the figures, has mounted thereon, for assembly, a cue tip 20 such as was described for FIG. 1. However, a tip 200 could as well be mounted on cue stick 33 and further assembled in the practice of the invention. Nevertheless, only tip 20 and its features will be referred to hereafter for simplicity, it being understood that such reference includes a tip 200 and its features.

There is disposed opposite the first side 55 of cue stick holder 54, a tip positioner 44 including a plate 46 with a second side 45 and a first, opposing side 47 facing toward the first side 55 of the stick holder 54. Plate 46 has a first bore 52 and a second bore 53 extending through plate 46 from side 45 to side 47.

Positioner 44 has at least three cavities 48A, 48B and 48C, shown in hidden lines in FIG. 7 (cavity 48B is shown sectionally in FIG. 8) for positioning a cue tip such as tip 20 on a cue stick such as stick 33. Although only three cavities are shown in the figures, it will be appreciated that plate 46 could be larger to hold a larger plurality of positioning cavities. Cavities 48A–C are advantageously provided to hold tip 20 having shapes such as having nickel radii and having outside diameters of 11.5–12.5 m.m., 12.5–13.5 m.m. and 13.5–14.5 m.m. It will be explained later that a cavity having a single size and shape is selected and aligned to a cue stick 33 in the practice of the invention for positioning, by engaging primarily its cap, a cue tip 20 to a cue stick 33.

It will be appreciated that the scale of FIG. 8 is too small to conveniently describe the positioning of a tip 20 so reference is made to FIGS. 1–6D in which positioning according to the prior art and to the instant invention was described in detail. Positioner 44, cavities 48A,B,C and the further apparatus of FIGS. 7-13 advantageously position cue tips such as tip 20 in the manner described in FIGS. 1, 3A–D, 4 and 6A–D.

The tip positioner 44 is connected to stick holder 54 with a moving and guiding system 60. System 60 includes a common guide post 62 fixedly attached to the first side 55 of holder 54 and extending slidably and pivotally through the second bore 53 of plate 46. Pin 62 is said to be common because it will be seen to guide plate 46 in aligning any one of a plurality of cavities 48 to a cue stick 33. System 60 also includes a mover pin 64 having a first, cap end 65 for bearing on the second side 45 of plate 46. Pin 64 also has a smooth shoulder portion 66 for extending through the first bore 52 of plate 46 to the first side 47. Pin 64 also has a second, end portion 67 for threadably and adjustably engaging pin 64 to the first side 55 of stick holder 54.

System 60 is adapted for adjustably, guidably moving together the positioner 44 and the stick holder 54 along a precise path for bringing the cue tip 20 or 200 into clamping contact with the free end of the cue stick 33, the centerlines of the desired dome of the cue tip and stick being held therealong in coincidence with the assembly axis for assembling the tip to the stick.

The mover pin 64 is also provided in the embodiment shown in FIGS. 7–10, to assist in aligning a cavity selected from plate 46 to the free, planar end 35 of a cue stick 33 fixedly held along assembly axis V—V. For such alignment, there are provided in first side 55 of stick holder 54, a plurality of threaded alignment bores 68A,B,C as variously shown in FIGS. 7–10.

Note, in each alignment step that the mover pin 64 is first threadably disengaged from holder 54 and plate 46 is pivoted about guide pin 62. Bore 68B (FIG. 8) is utilized with pins 64 and 62 to align cavity 48B to the stick 33. Note that mover pin 64 is threadably engaged to alignment bore 68B and that the action of guide pin 62 cooperates through plate 46 to accomplish the alignment (also seen in FIG. 7).

Figure 9:
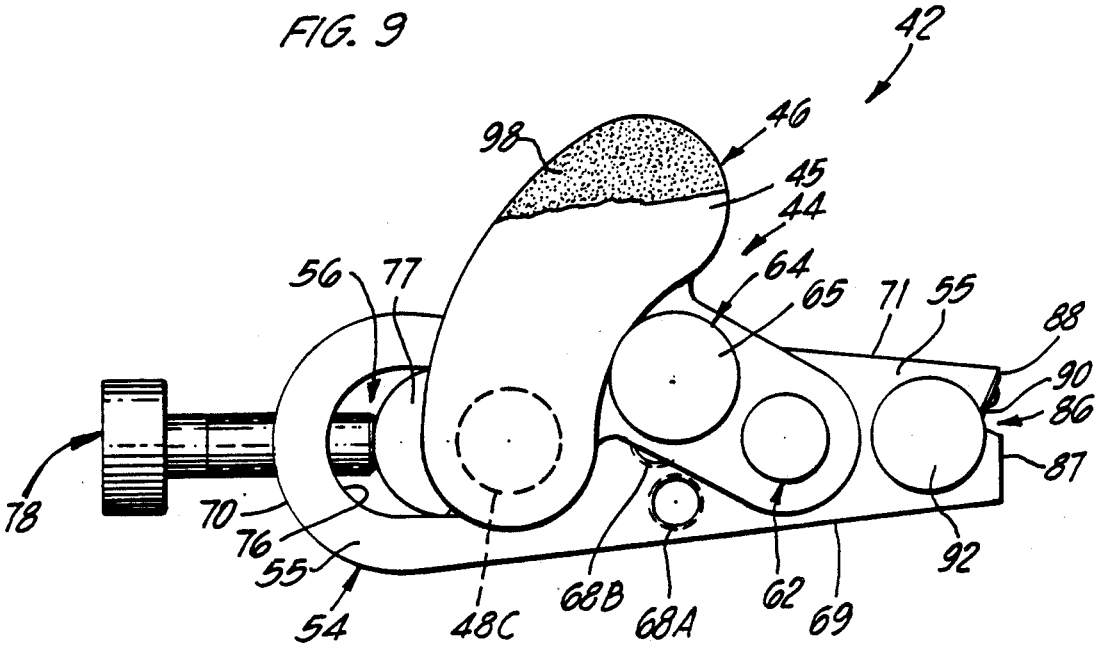
FIG. 9 is a plan view of the apparatus shown in FIG. 7, wherein a partially sectioned positioner plate is pivoted one way to align a third cavity (shown in phantom lines) to a cue stick (hidden).

Alignment bore 68A appears on first side 55 near a fourth side 69 of holder 54 in FIGS. 7 and 9. Bore 68A is utilized in FIG. 10 with pins 64 and 62 to align cavity 48A to the stick 33. Plate 46 is pivoted about guide pin 62 toward the fourth side 69 of holder 54 and the mover pin 64 is threadably engaged to alignment bore 68A (not seen in FIG. 10). The action of guide pin 62 and mover pin 64 cooperate through plate 46 to accomplish the alignment.

Figure 10:
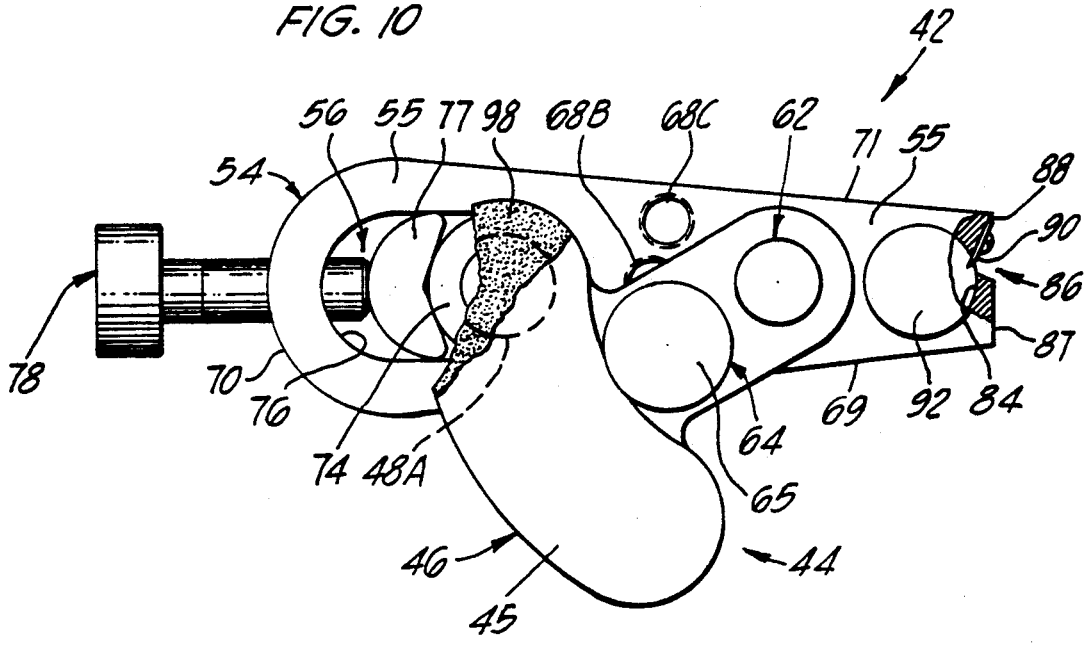
FIG. 10 is a plan view of the apparatus shown in FIG. 9, wherein a further sectioned positioner plate is pivoted a second way to align a first cavity (shown in phantom lines) to a cue stick (hidden).

Alignment bore 68C appears on first side 55 and near a fifth side 71 of holder 54 in FIGS. 7 and 10. Bore 68C is utilized (FIG. 9) with pins 64 and 62 to align cavity 48C to the cue stick 33. Plate 46 is pivoted about guide pin 62 toward the fifth side 71 of holder 54 and the mover pin 64 is threadably engaged to alignment bore 68C (not seen in FIG. 9). The action of the guide pin 62 and mover pin 64 cooperate through plate 46 to accomplish the alignment.

FIGS. 7–10 also illustrate in detail, expedients for fixedly holding cue stick 33 in the desired manner for practice of the invention. A clamping device 56 includes a compressible sleeve 74 to enclose a cue stick 33 within a thru-bore 76 in holder 54. Sleeve 74 is preferably cut through its wall longitudinally in a manner not seen in the figures to facilitate application to a stick without pushing sleeve 74 over an end of a stick 33. Sleeve 74 is desirably sufficiently resilient so application of compression to any side of the sleeve will distribute forces substantially undiminished about stick 33. For example, a plastic material such as a medium molecular weight polyethylene is found to perform the resilient distributing function for a sleeve 74 in the practice of the invention. Within thru-bore 76, there is provided a shoe 77 to laterally compress the sleeve 74, A pin 78 is threadably engaged to a third side 70 of the holder 54 and pin 78 is pivotally engaged to shoe 77. By turning pin 78 into the shoe 77, one compresses sleeve 74 against walls of bore 76, and the compression forces are distributed about the cue stick 33. An advantage of clamping device 56 is that cue sticks having a wide range of diameter measurements may be fixedly held about assembly axis V—V. For example, a sleeve 74 may be selected to handle cue sticks from 12 to 15 m.m. in diameter.

The apparatus 42 includes other devices for performing other functions associated with the assembly of cue tips to cue sticks For example, a trimmer 82 is provided in stick holder 54 for trimming excess material from an assembled cue tip. In second side 57 of the holder 54, a bore 84 is provided which is sufficiently wide to receive untrimmed cue tips ranging in diameter from 12 to 15 m.m. A groove 86 (FIG. 7) is cut into a sixth side 87 of holder 54 and into the bore 84, to provide a ledge 88 to support a sharp, razor edge blade 90 protruding at an angle into the periphery of bore 84 for a short distance. A thru-bore 93 is provided from first side 55 into bore 84 and a thumb screw 92 is threadably inserted to provide at its end 94, a stop for a cue tip.

In operation of the trimmer 82 one inserts a cue tip 20 shown mounted to a cue stick 33 in phantom lines in FIG. 8. The stick is then rotated and blade 90 trims unwanted portions 95 from an annular portion of tip 20 until the sides of tip 20 are even with the sides of the cue stick 33.

Figure 11:
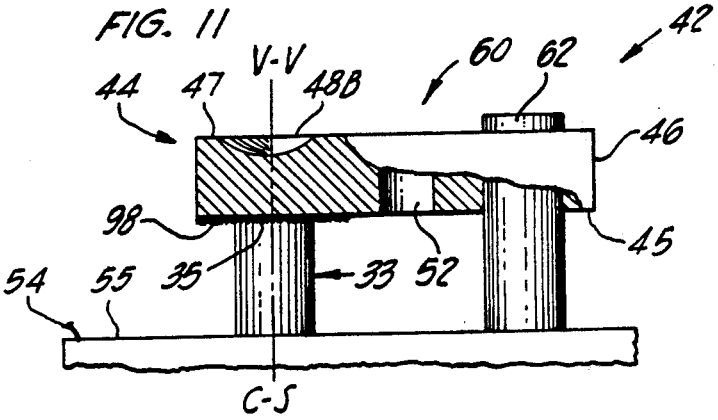
FIG. 11 is a partial side view of the apparatus shown in FIGS. 7–10. Said view is abbreviated and partially sectioned to show that a mover pin is removed and a positioner plate reverseably installed over a guide pin to contact an abrading pad to treat a free end of a fixedly held cue stick.

FIG. 11 illustrates how another function may be performed for assembling cue tips to sticks utilizing apparatus 42 of the invention. Prior to mounting a tip to a cue stick such as stick 33, the free end 35 is typically cleaned of all debris and (sometimes) dried remnants of adhesive. Also, the free end 35 is desirably made into a plane disposed normally to the internal centerline C-S of stick 33 and to the assembly axis V—V.

It can be seen in FIGS. 7–11 and 13 that plate 46 has provided on its second side 45 an abrasive pad 98 made of rough sandpaper, silicon carbide or a similar material, extensively applied as best seen in FIG. 7. For treating a free end of a cue stick, the mover pin 64 is first threadably disengaged from the holder 54 and removed from plate 46. Plate 46 is then removed from pin 62 and inverted and again slidably placed over pin 62 to bring the pad 98 on the second side 45 of plate 46 into contact with the free end 35 of stick 33. Plate 46 is then pivotally reciprocated to move pad 98 back and forth over end 35 until end 35 is cleaned and machined into a condition satisfactory for mounting a cue tip to a stick.

Figure 12:
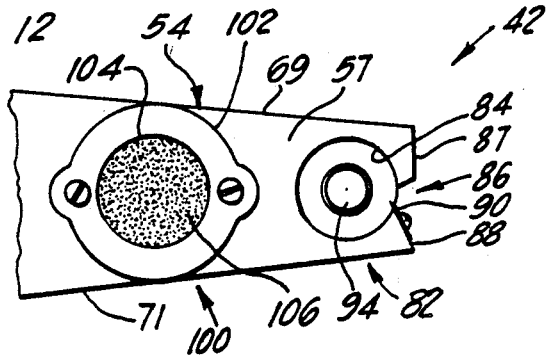
FIG. 12 is a partial bottom view of a stick holder showing a tip scruffer and a tip trimmer.

FIG. 12 illustrates how another function may be performed for assembling cue tips to sticks utilizing apparatus 42 of the invention. After a tip is mounted to a cue stick, and sometimes after playing a game or more, a tip may get deformed or too smooth for good play. To restore such a tip, a scruffer 100 is provided and attached to second side 57 of holder 54 as shown in section in FIG. 8 and in plan view in FIG. 12. Scruffer 100 includes a generally circular plate 102 having a central, concave depression 104 covered with an abrading material such as silicon carbide grit 106. Such grit 106 may be brazed or otherwise bonded to the depression 104. In operation, a tip 20 of a stick 33 is placed in the depression 102 and rotated. The grit shapes a tip to a proper curvature and scruffs it at the same time to facilitate acceptance of chalk on a cue stick for good play.

Figure 13:
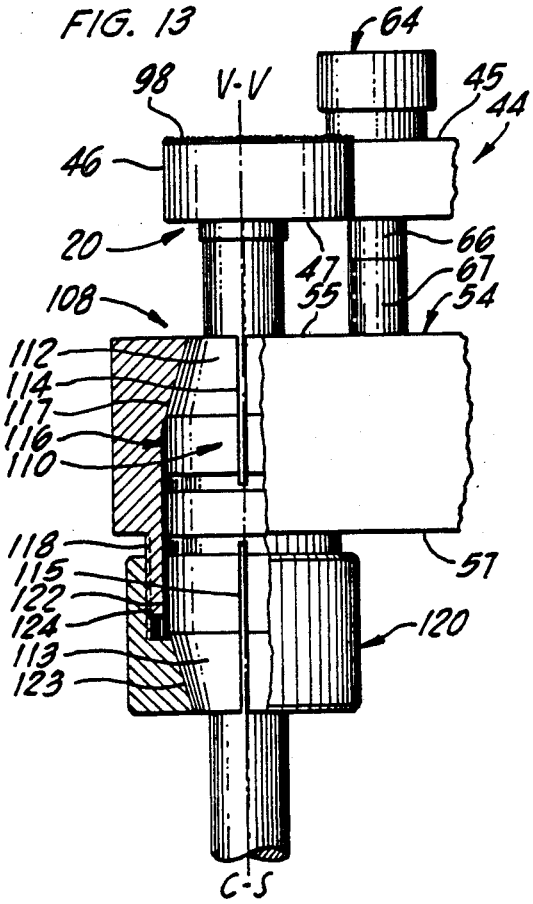
FIG. 13 is a partial, cut-away side view of the apparatus shown in FIGS. 7–10, except that a collet is used to fixedly hold a cue stick.

FIG. 13 illustrates an alternate method of clamping a cue stick utilizing a device referred to as a collet 108. Collet 108 includes a sleeve 110 having tapered ends 112 and 113 and compressible slots 114 and 115. There is provided in holder 54, a thru-bore 116 having a tapered portion 117 extending to the first side 55 of holder 54 and an externally threaded shoulder 118 at the second side 57. There is provided at the shoulder 118, a movable cap 120 having a bore 122 with a tapered portion 123 and an internally threaded portion 124.

In operation of the clamping device 108, one inserts a cue stick 33 through sleeve 110 whereby a tip 20 and the stick centerline C-S are aligned about assembly axis V—V. Cap 120 is then threadably engaged by rotation about shoulder 118. The tapered portion 123 bears upon tapered end 113 of sleeve 110 which tends to force tapered end 112 of sleeve 110 into compression with tapered portion 117 of thru-bore 116. Such compression tends to close slots 114 and 115 and bring sleeve 110 into compression around cue stick 33.

Figure 14:
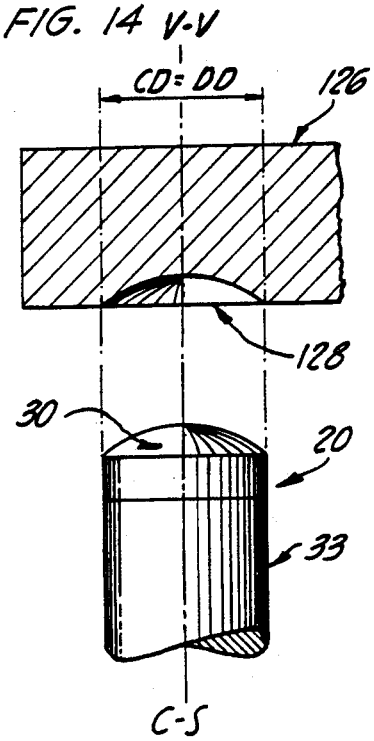
FIG. 14 is a view similar to FIG. 3A, but it shows a smaller positioner cavity.

In the discussion of FIGS. 1-6D, it was mentioned that a positioning cavity need not be larger than a cap 20 in the practice of the invention. FIG. 14 is provided to show a positioner plate 126 having a cavity 128 over a tip 20 of a cue stick 33. It is found that the cavity 128 may have a diameter CD equal to the diameter DD of a desired dome 30 of an assembled tip and still position a tip symmetrically to an assembly axis V—V according to the invention.

There have been illustrated herein certain embodiments of the invention and certain applications of the embodiments. Nevertheless, it is to be understood that various modifications and refinements may be made and utilized which differ from these disclosed embodiments without departing from the spirit and scope of the present invention.

What is claimed is:

1. Apparatus for assembling to a cue stick, a tip having a convex cap portion for striking a ball and a portion with a planar end for connecting the tip to such cue stick, said cap portion having a base and theoretical plane joining the connecting portion of the tip, and wherein said cap and its base plane may be randomly tilted in a non-parallel manner or be parallel with respect to the planar end of the tip, comprising:

a stick holder having first and second opposing sides, and means for fixedly holding a cue stick such that an internal centerline of such stick coincides with a given assembly axis and a free, tip end of such cue stick protrudes from the first side of the holder;

disposed opposite the first side of the holder, a tip positioner having a second side and a first, opposing side facing toward the first side of the stick holder including means for positioning at least one cue tip, by engaging primarily the cap so a desired dome portion of such cap has a desired theoretical base plane and, normally thereto, a desired centerline coinciding with the assembly axis and the connecting portion of the tip has its planar end facing toward and parallel with the free, tip end of the cue stick, said ends of the tip and stick also being parallel with the base plane of the dome; and connecting the tip positioner to the holder, means for adjustably, guidably, moving together the positioner and the holder along a precise path for bringing the cue tip into pressing contact with the cue stick, without tilting the connecting end of the tip on the free end of the cue stick even though the cap portion may be tilted on the cue tip, the centerlines of the desired dome of the cue tip and stick being held therealong in coincidence with the assembly axis for assembling the tip to the stick.

2. Apparatus for assembling to a cue stick, a tip having a convex cap portion for striking a ball and a portion with a planar end for connecting the tip to such cue stick, said cap portion having a base and theoretical plane joining the connecting portion and said plane being tilted in a nonparallel manner with respect to the planar end of the tip, comprising:

a stick holder having first and second opposing sides including means for fixedly holding a cue stick such that an internal centerline of such stick coincides with a given assembly axis and a free, tip end of such cue stick protrudes from the first side of the holder;

disposed opposite the first side of the holder, a tip positioner having a second side and a first, opposing side facing toward the first side of the stick holder including means for positioning at least one cue tip so a desired dome portion of its cap has a desired theoretical base plane and, normally thereto, a desired centerline coinciding with the assembly axis, the connecting portion of the tip having its planar end facing toward and parallel with the free, tip end of the cue stick, said ends of the tip and stick also being parallel with the base plane of the dome; and connecting the tip positioner to the holder, means for adjustably, guidably, moving together the positioner and the holder along a precise path for bringing the cue tip into pressing contact with the free end of the cue stick, the centerlines of the desired dome of the cue tip and stick being held therealong in coincidence with the assembly axis for assembling the tip to the stick.

3. Apparatus as in claim 2, wherein the means for positioning a cue tip, comprises:

at the first side of the positioner, a cavity having internal surfaces curved to match the external surfaces of the convex cap of the cue tip, a dome portion of such cavity having a desired theoretical base plane and, normally thereto, a centerline coinciding with the assembly axis; and to accommodate a tip which may have the base plane of its cap portion tilted with respect to the planar end of its connecting portion, said cavity being sufficiently wide to facilitate moving the tip normally, laterally and rotatively to the assembly axis as required until the desired dome portion of the cap fits into the desired dome portion of the cavity and such that the means for moving together the positioner and the stick holder may press the tip to the cue stick without tilting the connecting end of the tip with respect to the free end of the cue stick even though the cap portion is tilted on the cue tip.

4. Apparatus for assembling to a cue stick, a tip having a convex cap portion for striking a ball and a portion with a planar end for connecting the tip to such cue stick, comprising:

a stick holder, having first and second opposing sides, including means for fixedly holding a cue stick such that an internal centerline of such stick coincides with a given assembly axis and a free, tip end of such cue stick protrudes from the first side of the holder;

disposed opposite the first side of the holder, a tip positioner having a second side and a first, opposing side facing toward the first side of the stick holder, including means for positioning at least one cue tip, by engaging primarily the cap, so a desired dome portion of such cap has a desired centerline coinciding with the assembly axis and the connecting portion of the tip has its planar end facing toward and parallel with the free, tip end of the cue stick; and connecting the tip positioner to the holder, means for adjustably, guidably, moving together such positioner and the holder along a precise path for bringing the cue tip into clamping contact with the free end of the cue stick, the centerlines of the desired dome of the cue tip and stick being held therealong in coincidence with the assembly axis for assembling the tip to the stick.

5. Apparatus as in claim 4, wherein the cap portion of the tip has a base and theoretical plane joining the connecting portion of the tip, further comprising:

means for positioning the cue tip so the desired dome portion of the cap has a desired theoretical base plane normal to the desired centerline of the dome and assembly axis, said base plane being parallel to the planar end of the cue tip and the free end of the cue stick even though the base plane of the cap may be tilted with respect to the planar end of the tip.

6. Apparatus as in claim 4, wherein the cap portion of the tip has a base and theoretical plane joining the connecting portion of the tip, further comprising:

at the first side of the positioner, at least one cavity having internal surfaces curved to substantially complement and accept the external surfaces of the convex cap of the cue tip, a dome portion of such cavity having a desired theoretical base plane and, normally thereto, a centerline coinciding with the assembly axis; and to accommodate a tip having a cap with its base plane randomly disposed with respect to the planar end of its connecting portion, said cavity being sufficiently wide to facilitate positioning the tip normally, laterally and rotatively to the assembly axis as required until the desired dome portion of the cap fits into the desired dome portion of the cavity and such that the means for moving together the positioner and stick holder may press the tip to the free end of the cue stick without tilting the connecting end of the tip with respect to the free end of the cue stick even though the cap portion is tilted on the cue tip.

7. Apparatus as in claim 4, wherein the tip positioner further comprises:

means for positioning selected ones of a plurality, containing more than a single size and shape of cue tips, by engaging primarily the cap of such cue tip of a selected size and shape.

8. Apparatus as in claim 7, wherein the tip positioner, the moving means and the stick holder, further comprise:

a positioner plate having a second side and a first, opposing side facing toward the first side of the stick holder, there being at least first and second bores extending from the first side through the second side of said plate;

a common guide post fixedly attached to the first side of the stick holder and extending slidably and pivotally through the second bore of the positioner plate;

a mover pin having a first, cap end for bearing on the second side of the positioner plate, a smooth shoulder portion for extending through the first bore of the positioner plate to the first side and a second, end portion for threadably and adjustably engaging to the first side of the stick holder;

a plurality of cap engaging, tip positioning cavities in the first side of the positioner plate, each cavity having a desired dome portion and centerline thereof to be aligned to coincide with the given assembly axis, and in the first side of the stick holder, a plurality of threaded alignment bores to accept and adjustably engage to the mover pin, each of said bores being so disposed with respect to the common guide pin and a given tip positioner cavity that engaging the mover pin in said bore will align the given cavity so its desired dome centerline coincides with the assembly axis and further threadably engaging the mover pin into the alignment bore will adjustably, guidably move together, the positioner and the stick holder along the precise path for assembling a tip to cue stick.

9. Apparatus as in claim 8, wherein the cue stick is clamped within a compressible sleeve in a thru-bore in the holder, further comprising:

a shoe to laterally compress the sleeve against walls of the bore and about the cue stick;

a pin threadably engaged to a third side of the holder and pivotally engaged to the shoe to move the shoe into and out of compression with the sleeve, the bore and the cue stick.

10. Apparatus as in claim 8, wherein the cue stick is clamped by a collet in the holder, further comprising:

around the cue stick, a sleeve having tapered ends and compressible slots in its walls;

in the holder, a bore having a tapered portion extending to the first side of the stick holder for holding the sleeve and a cue stick therein and fitted with a threaded shoulder at the second side of the holder; and a movable cap having a tapered bore for holding the sleeve and a cue stick therein and a threaded portion for engaging and closing on the threaded shoulder at the bore on the holder such that the sleeve is longitudinally compressed so the slots tend to close and bias the sleeve around and into compression with a cue stick.

11. Apparatus as in claim 8, wherein the positioner plate has on its second side, means for abrading a cue stick, further comprising:

said mover pin being disengageable from the stick holder and removable from the plate such that the positioner may be inverted and have its second side face the first side of the stick holder so the free end of a cue stick may be engaged with the abrading means; and said positioner plate being pivotally and slidably engaged to the guide pin such that the plate may be arcuately reciprocated with respect to such pin and the abrading means may be laterally moved over, and into pressing contact with a cue stick for precisely forming the free end, into a plane normal to the centerline of the stick and assembly axis in preparation for assembling a tip to such cue stick.

12. Apparatus as in claim 8, wherein the stick holder contains means for trimming a cue tip after assembling the same to a cue stick such that the desired dome portion of the cap is aligned to the sides of the cue stick.

13. Apparatus as in claim 8, wherein the stick holder contains means for scruffing a cue tip after assembling the same to a cue stick.

14. Apparatus as in claim 8, wherein the weight of the stick holder, the tip positioner, and the moving means is less than 1.1 pounds and the size of apparatus readily fits the size of a standard cue stick pouch.

* * * * *